US006238233B1

(12) United States Patent
Drexler et al.

(10) Patent No.: US 6,238,233 B1
(45) Date of Patent: May 29, 2001

(54) CONNECTING DEVICE FOR AT LEAST ONE NON-BARED CONDUCTOR

(75) Inventors: Johann Drexler, Schwandorf; Hubert Klose, Ammerthal; Siegfried Koller, Amberg; Hartmut Schumacher, Ebermannsdorf, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/355,134

(22) PCT Filed: Jan. 9, 1998

(86) PCT No.: PCT/DE98/00068

§ 371 Date: Sep. 20, 1999

§ 102(e) Date: Sep. 20, 1999

(87) PCT Pub. No.: WO98/33235

PCT Pub. Date: Jul. 30, 1998

(30) Foreign Application Priority Data

Jan. 22, 1997 (DE) ..... 197 02 129

(51) Int. Cl.[7] ..... H01R 4/24
(52) U.S. Cl. ..... 439/409; 439/459
(58) Field of Search ..... 439/409, 410, 439/413, 417, 459

(56) References Cited

U.S. PATENT DOCUMENTS

| | | | | |
|---|---|---|---|---|
| 5,041,012 | * | 8/1991 | Caprio | 439/409 |
| 5,154,633 | | 10/1992 | Lee | 439/409 |
| 6,086,406 | * | 7/2000 | Francois et al. | 439/413 |

FOREIGN PATENT DOCUMENTS

| | | | | |
|---|---|---|---|---|
| 0 243 887 | | 11/1987 | (EP) . | |
| 0338952 | * | 10/1989 | (EP) | 439/413 |
| 0340075 | * | 11/1989 | (EP) | 439/413 |
| 0 511 098 | | 10/1992 | (EP) . | |
| 0 735 613 | | 10/1996 | (EP) . | |
| 2 210 514 | | 6/1989 | (GB) . | |
| 2 210 734 | | 6/1989 | (GB) . | |
| 0780089 | * | 11/1980 | (SU) | 439/409 |

* cited by examiner

*Primary Examiner*—Gary F. Paumen
*Assistant Examiner*—Tho D. Ta
(74) *Attorney, Agent, or Firm*—Kenyon & Kenyon

(57) ABSTRACT

A connection terminal is provided which makes it possible to connect two different, side-by-side, unstripped conductors when working with a narrow bed width. This is accomplished by providing a cutting member having a plurality of contact cutting edges of variable height, in conjunction with a lever whose clamping member presses the inserted conductors against the contact cutting edges until the conductor cores are contacted.

8 Claims, 3 Drawing Sheets

CONNECTING DEVICE FOR AT LEAST ONE NON-BARED CONDUCTOR

FIELD OF THE INVENTION

The present invention relates to a connection terminal for at least one unstripped conductor cable, having a cutting member which has a plurality of contact cutting edges for cutting through the insulation.

BACKGROUND INFORMATION

A connection terminal of this type is described in European Patent No. 0 511 098. It includes a metallic component which is affixed in a space of a housing and forms at least one connection unit having a convex hexagonal shape, and having a slit along one of its diagonal planes. The slit is used to hold the wire and to cut through the insulation in order to contact the conductor core. The slit has a widened mouth for cutting through the wire insulation with cutting edges.

U.S. Pat. No. 5,154,633 describes an insulation piercing connecting device for the penetration contacting of a conductor. The device includes a plurality of contact points of the same height which are arranged, one after another, in a direction of the conductor axis. The contact points are designed as swords which penetrate to the same depth into the conductor during the contacting operation. This design of contact points is not suitable for contacting conductors having different cross-sections.

British Patent No. GB 2 210 734 describes a contacting method in which a contacting element having teeth is used. No points are used for the contacting, but, rather, variably high cutting edges along the side at each tooth. Upon insertion of the conductor, the cutting edges rip open the insulation and contact the actual conductor core.

SUMMARY

An object of the present invention is to provide a connection terminal of the above-named type which, in a simple manner, permits a contacting of conductors having different diameters, irrespective of the insulation material, and at the same time is suitable for massive, fine-wire and multiple-wire conductor cross-sections.

This objective is achieved according to the present invention, in that the points of the contact cutting edges are set apart at variable distances from the axis of the conductor introduced into the connection terminal and located in contacting position, that the connection terminal has a clamping member which, in one mounting position, has an intervening space with a graduated variable opening width with respect to the contact cutting edges, so that conductors having different cross-sections can be inserted so far into the intervening space that at least one of the contact cutting edges overlaps the conductor, and that due to the action of force on the clamping member, the inserted conductor can be forced into at least one of the overlapping contact cutting edges to the extent that the conductor core is contacted.

For example, if the clamping member is spring-loaded, then good contacting can be maintained which is long-lasting, since the spring action compensates for a slackening of the contacting forces.

Advantageously, the clamping member is the lower part of a rotationally mounted lever having springs which act on the clamping member. The lever is normally mounted in the housing of a switching device, and therefore is accommodated in a manner that it is safe from loss. Using the lever, the pressure necessary for the contacting with the contact cutting edges can be applied with the assistance of a screwdriver, without great expenditure of force.

The connection terminal of the present invention facilitates the connection of conductors, because the lever can be locked in an open position and in a contacting position. The contacting position is thus secured at the same time.

The clamping member may have two regions, formed by a slit, which are flexible independently of one another, this likewise permits two contacted conductors, lying side-by-side, to be contacted independently of one another, and the contact state can be better maintained.

In addition, The connection terminal may be provided in a switching device, and the cutting member may be used at the same time as a contact member of the switching device.

Production can be accomplished particularly simply if the cutting member is composed of a plurality of cutting plates having a saw-toothed profile.

DETAILED DESCRIPTION

Figure 1:
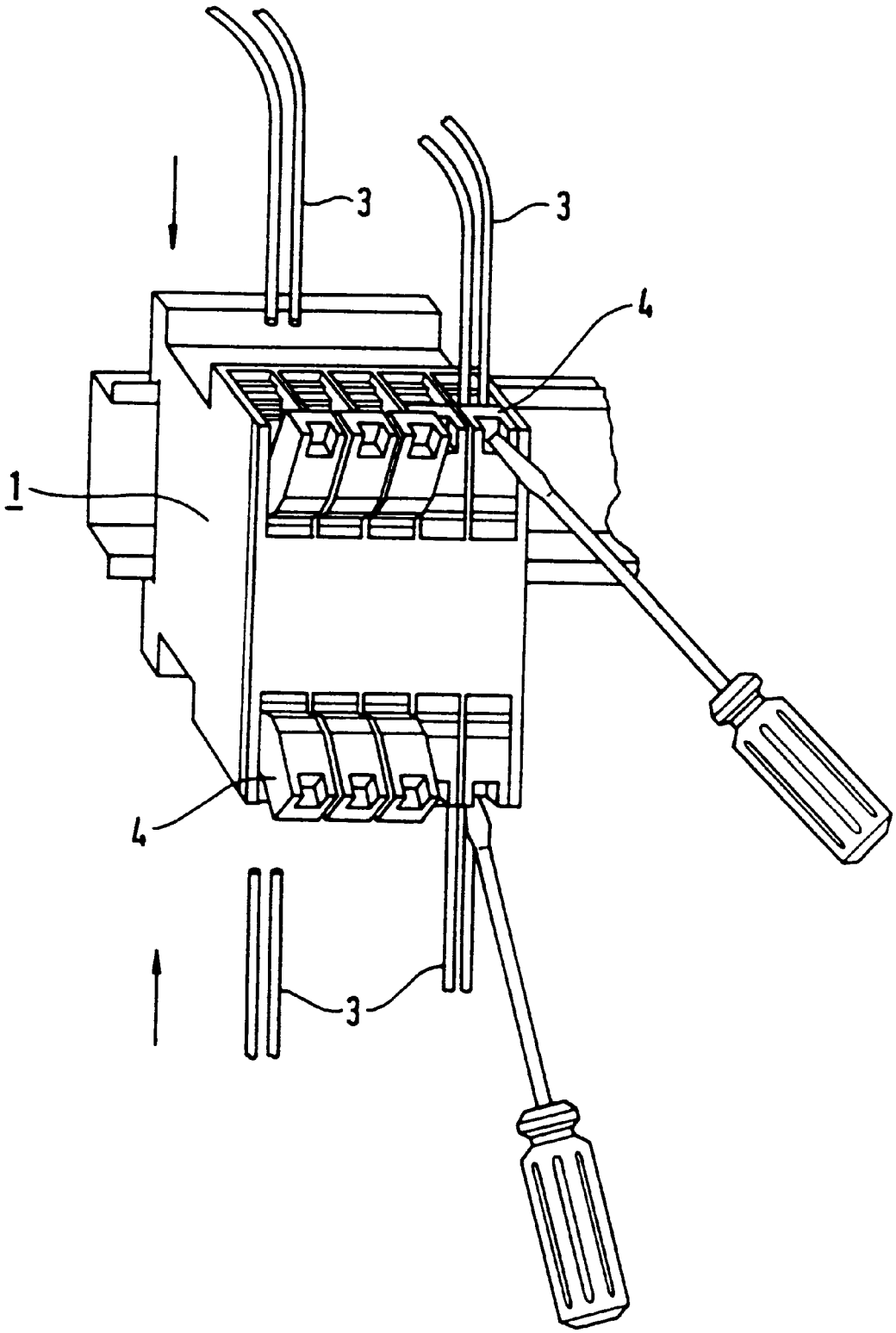
FIG. 1 shows a switching device with profile section terminals according to the present invention.

FIG. 1 shows a switching device 1 which is equipped with profile terminals 2 according to the present invention for the connection of electric conductors 3. Levers 4 of profile terminals 2 are shown in part the open position, i.e., when conductor 3 is not contacted, and are shown in part in the closed position when conductor 3 is contacted. Levers 4 can be locked in the open position and in the contacting position, respectively. Two different unstripped conductors 3, lying side-by-side, can be contacted by each profile terminal 2. The conductors can be massive or fine-wire conductors 3 having different cross-sections, e.g., in the range of 0.5 to 2.5 $mm^2$.

Figure 2:
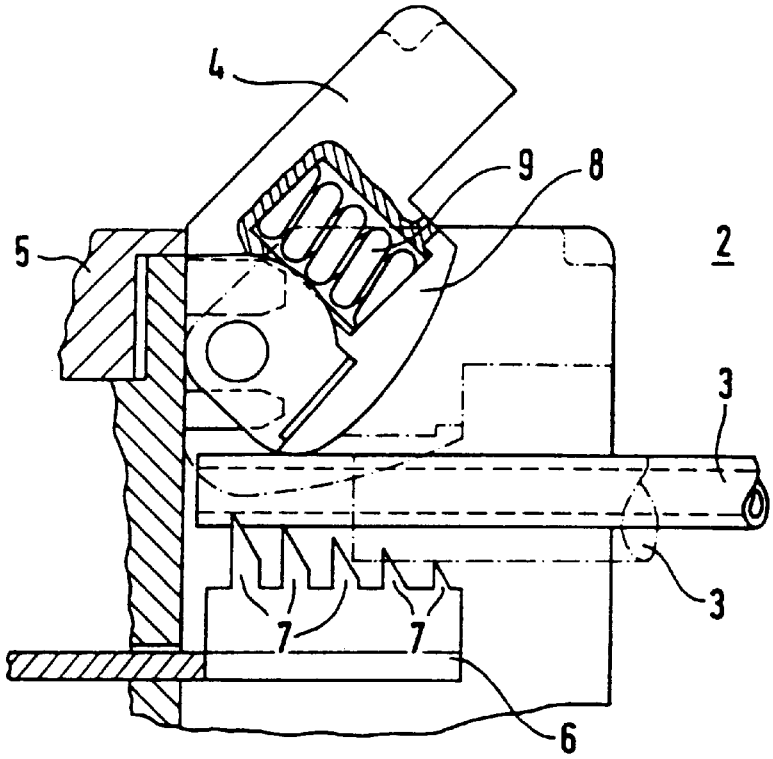
FIG. 2 shows a sectional view of a profile terminal of the present invention.

FIG. 2 shows a sectional view of a profile terminal 2 in a housing 5 of, e.g., a switching device 1. Profile terminal 2 includes a cutting member 6 having a plurality of contact cutting edges 7 of variable height which, e.g., is produced by cutting plates having a saw-toothed profile. This cutting member 6 at the same time represents the contact member of switching device 1. Lever 4 is rotationally mounted in housing 5 opposite cutting member 6. When lever 4 is in the open position, as shown in FIG. 2, an electric conductor 3 can be introduced into the intervening space between lever 4 and cutting member 6. The heights of contact cutting edges 7 are graduated in such a way that, with increasing insertion depth, the opening width for inserting electric conductors 3 between contact cutting edges 7 and lever 4 is reduced. Thus, electric conductors 3 having a small diameter can be inserted further than those with a large diameter, which is indicated in FIG. 2 by the two conductors 3 shown, which have different cross-sections. On its bottom side, lever 4 has a spring-loaded clamping member 8 as a lower part. When lever 4 is swung around into the position shown by a dotted line, conductors 3 are pressed into contact cutting edges 7, resulting in graduated cutting into the insulation and the contacting of conductors 3. A reliable strain relief of electric conductors 3 is achieved by clamping the insulation.

Figure 3:
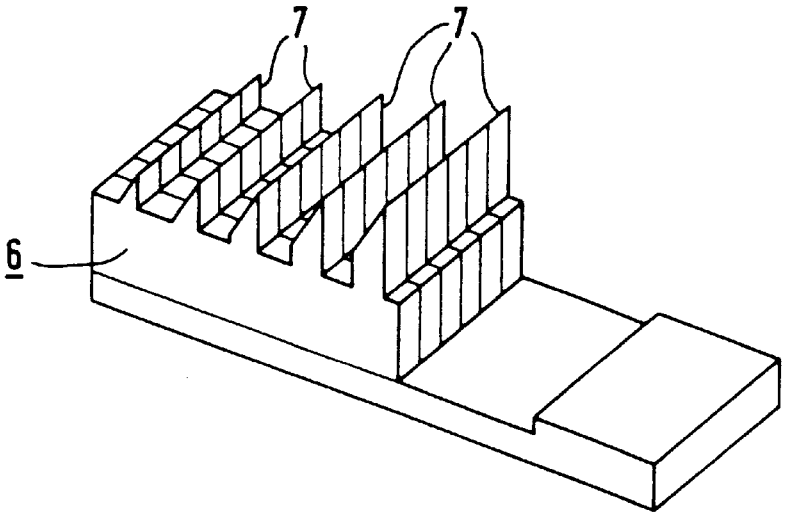
FIG. 3 shows a contact member of the profile terminal according to FIG. 2.

FIG. 3 shows cutting member 6, having contact cutting edges 7, which is used at the same time as the contact member. Cutting member 6 can be produced by cutting plates having a saw-tooth profile. The cutting plates can be punched with a saw-tooth profile, stacked, and integrally joined for the contact member. In this specific embodiment, the current flows directly from the conductor to the contact member. The height of contact cutting edges 7 increases starting from the end serving as the insertion side, in order to achieve opening widths which are appropriately adjusted for unstripped conductors 3 having different diameters.

Figure 4:
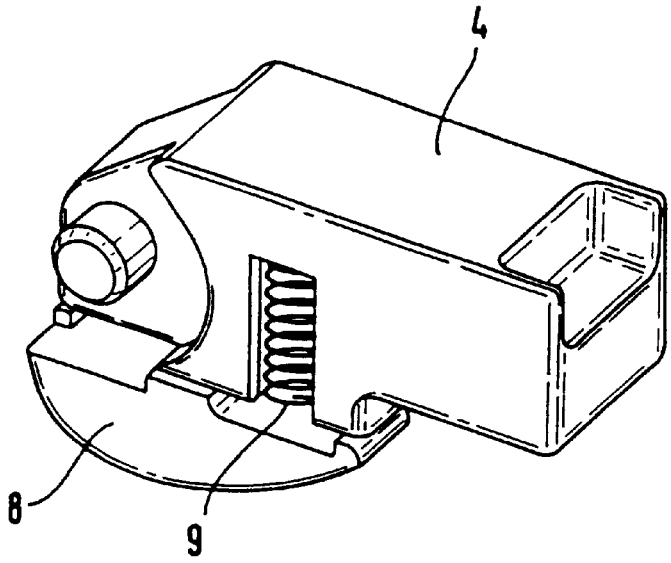
FIG. 4 shows a lever of the profile terminal in the mounted state.
Figure 5:
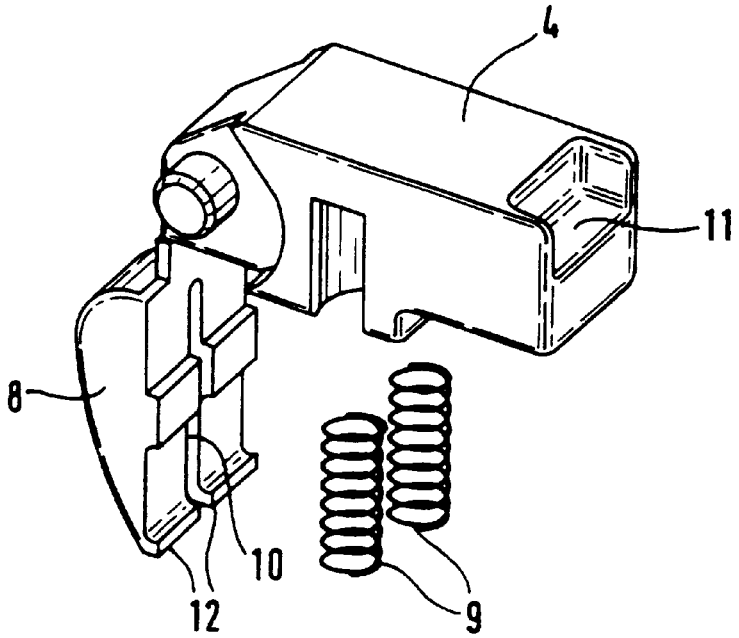
FIG. 5 shows a perspective view of the lever according to FIG 4 in the unmounted state.

FIGS. 4 and 5 show lever 4 with clamping member 8. Lever 4 can be swivelled by way of a pivot bearing in housing 5 of a switching device 1. Lever 4 includes an upper part, in which two springs 9 are mounted which act upon clamping member 8 having a rounded-off outer surface. This lower part may be constructed in one piece, but because it is formed with a slit 10, it has two regions 12 which are flexible independently of one another, one of springs 9, respectively, pressing on each region 12. The two contacted electric conductors 3 according to FIG. 2 are pressed with spring-loading onto contact cutting edges 7 by way of these regions. A possible slackening or readjustment of the contacting forces is compensated by the spring action. Due to this design, the contacting is retained unchanged for longer operating times as are customary for switching devices. Lever 4 is provided with a recess 11, via which a simple manipulation is possible with the assistance of a screwdriver (see FIG. 1). The connecting points can be indicated appropriately by different coloring of levers 4.

The space expenditure necessary for the connection of a conductor, in particular the "bed width", is determined by the conductor itself in the case of the profile terminal. In comparison, in a screw terminal, the bed width is larger by at least the diameter of the terminal screws.

Although the present invention is explained with reference to the specific embodiment shown in the attached drawing, it should be taken into account that the intention is not to limit the present invention only to the specific embodiment shown, but rather to include all possible changes, modifications and equivalent arrangements insofar as they are covered by the contents of the Patent Claims.

What is claimed is:

1. A connection terminal for at least one unstripped conductor, comprising:

a cutting member including contact cutting edges for cutting through an insulation of the at least one unstripped conductor, points of the contact cutting edges being set apart at variable distances from a longitudinal conductor axis of the conductor introduced into the connection terminal and located in contacting position, the contact cutting edges extending traversely to the longitudinal conductor axis; and a clamping member which, in one mounting position, has an intervening space with a graduated variable opening width with respect to the contact cutting edges so that conductors having different cross-sections can be inserted so far into the intervening space that at least one of the contact cutting edges overlaps the inserted conductor, the inserted conductor being forced, by an action of force on the clamping member, into the at least one of the contact cutting edges to the extent that a conductor core is contacted, the graduated variable width of the intervening space being graduated in a direction along the longitudinal conductor axis.

2. The connection terminal according to claim 1, wherein the clamping member is spring-loaded.

3. The connection terminal according to claim 1, wherein the clamping member has two regions formed by a slit which are flexible independently of one another.

4. The connection terminal according to claim 1, wherein the connection terminal is provided in a switching device, the cutting member serving as a contact member of the switching device.

5. The connection terminal according to claim 1, wherein the contact cutting edges are formed by a plurality of cutting plates having a saw-tooth profile.

6. A connection terminal for at least one unstripped conductor, comprising:

a cutting member including contact cutting edges for cutting through an insulation of the at least one unstripped conductor, points of the contact cutting edges being set apart at variable heights from a longitudinal conductor axis of the conductor introduced into the connection terminal and located in contacting position, the contact cutting edges extending traversely to the longitudinal conductor axis;

a clamping member which, in one mounting position, has an intervening space with a graduated variable opening width with respect to the contact cutting edges so that conductors having different cross-sections can be inserted so far into the intervening space that at least one of the contact cutting edges overlaps the inserted conductor, the inserted conductor being forced, by an action of force on the clamping member, into the at least one of the contact cutting edges to the extent that a conductor core is contacted, the clamping member is a lower part of a rotationally-mounted lever; and springs acting upon the clamping member.

7. The connection terminal according to claim 6, wherein the lever is lockable in an open position and in a contacting position.

8. A connection terminal for at least one unstripped conductor, comprising:

a housing;

a cutting member arranged in the housing and including contact cutting edges for cutting through an insulation of the at least one unstripped conductor, points of the contact cutting edges being set apart at variable heights from a longitudinal conductor axis of the conductor introduced into the connection terminal and located in contacting position, the contact cutting edges extending traversely to the longitudinal conductor axis; and a clamping member, arranged in the housing, which, in one mounting position, has an intervening space with a graduated variable opening width with respect to the contact cutting edges so that conductors having different cross-sections can be inserted so far into the intervening space that at least one of the contact cutting edges overlaps the inserted conductor, the inserted conductor being forced, by an action of force on the clamping member, into the at least one of the contact cutting edges to the extent that a conductor core is contacted, the graduated variable width of the intervening space being graduated in a direction along the longitudinal conductor axis.

* * * * *